US006847798B2

(12) United States Patent
Cho et al.

(10) Patent No.: US 6,847,798 B2
(45) Date of Patent: Jan. 25, 2005

(54) FUSING DEVICE FOR AN ELECTROPHOTOGRAPHIC IMAGE FORMING APPARATUS

(75) Inventors: Durk-hyun Cho, Gyeonggi-do (KR); Hwan-guem Kim, Seoul (KR); Narbut Aleexandr, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/624,899

(22) Filed: Jul. 23, 2003

(65) Prior Publication Data

US 2004/0141777 A1 Jul. 22, 2004

(30) Foreign Application Priority Data

Oct. 22, 2002 (KR) ..... 10-2002-0064545

(51) Int. Cl.[7] ..... G03G 15/20
(52) U.S. Cl. ..... 399/330; 219/216; 432/60
(58) Field of Search ..... 399/307, 330, 399/334; 219/216, 388, 469; 432/60; 492/46

(56) References Cited

U.S. PATENT DOCUMENTS 5,426,495 A * 6/1995 Sawamura et al. ..... 399/331
5,805,766 A * 9/1998 Wang ..... 392/343
5,945,020 A * 8/1999 Kuroda et al. ..... 219/543
5,987,295 A * 11/1999 Matsuo et al. ..... 399/330
6,571,080 B2 * 5/2003 Lee et al. ..... 399/330
6,580,896 B2 * 6/2003 Lee ..... 399/330
6,628,917 B2 * 9/2003 Lee ..... 399/330
6,665,515 B2 * 12/2003 Lee ..... 399/330

FOREIGN PATENT DOCUMENTS

JP 10268686 A * 10/1998 ..... G03G/15/20
JP 11065340 A * 3/1999 ..... G03G/15/20
JP 11184290 A * 7/1999 ..... G03G/15/20

* cited by examiner

*Primary Examiner*—Robert Beatty
(74) *Attorney, Agent, or Firm*—Staas & Halsey LLP

(57) ABSTRACT

A fusing device for an electrophotographic image forming apparatus. The fusing device includes a heat pipe, both ends of which are sealed and in which a predetermined amount of a working fluid is contained, a cylindrical roller which surrounds the heat pipe, and a heating element which is installed between the cylindrical roller and the heat pipe. The working fluid is supercooled at room temperature, and crystallizing and producing heat when acted on by a mechanical force, and at least one mechanical unit applies a mechanical force to the heat pipe and crystallizes the supercooled working fluid.

10 Claims, 5 Drawing Sheets

FUSING DEVICE FOR AN ELECTROPHOTOGRAPHIC IMAGE FORMING APPARATUS

CROSS-REFERENCE TO RELATED APPLICATIONS

This application claims the priority of Korean Patent Application No. 2002-64545, filed on Oct. 22, 2002, in the Korean Intellectual Property Office, the disclosure of which is incorporated herein in its entirety by reference.

BACKGROUND OF THE INVENTION

1. Field of the Invention

The present invention relates to a fusing device for an electrophotographic image forming apparatus, and more particularly, to a fusing device for an electrophotographic image forming apparatus that uses heat generated when supercooled sodium acetate is crystallized, for an instant rising temperature of a fusing roller.

2. Description of the Related Art

In general, an electrophotographic printer includes a fusing device which heats the paper onto which a toner image is transferred, melts the toner image in a powder state on the paper, and fuses the melted toner image on the paper. The fusing device includes a fusing roller which fuses toner onto the paper, and a pressing roller which pushes the paper against the fusing roller.

FIG. 1 is a schematic profile cross-sectional view of a conventional fusing roller using a halogen lamp as a heat source, and FIG. 2 is a schematic frontal cross-sectional view of a conventional fusing device using the fusing roller of FIG. 1. Referring to FIG. 1, a fusing roller 10 includes a cylindrical roller 11 and a halogen lamp 12 installed inside the cylindrical roller 11. A TEFLON® coating layer 11*a* is formed on a circumference of the cylindrical roller 11. The cylindrical roller 11 is heated by radiant heat generated from the halogen lamp 12.

Referring to FIG. 2, a pressing roller 13 is placed under the fusing roller 10 to be opposite to the fusing roller 10, and paper 14 is placed between the fusing roller 10 and the pressing roller 13. The pressing roller 13 is elastically supported by a spring 13*a*. The pressing roller 13 closely adheres the paper 14, which is passing between the fusing roller 10 and the pressing roller 13, to the fusing roller 10 with a predetermined pressure. In this case, the toner image 14*a*, which is formed on the paper 14 in a powder state, is fused on the paper 14 due to the predetermined pressure and heat while passing between the fusing roller 10 and the pressing roller 13.

A thermistor 15 and a thermostat 16 are installed at one side of the fusing roller 10. The thermistor 15 measures a surface temperature of the fusing roller 10, and the thermostat 16 cuts off power supplied to the halogen lamp 12 when the surface temperature of the fusing roller 10 exceeds a predetermined value. The thermistor 15 measures the surface temperature of the fusing roller 10 and transmits an electrical signal corresponding to the measured temperature to a controller (not shown) of a printer (not shown). The controller controls the power supplied to the halogen lamp 12 according to the measured temperature and maintains the surface temperature of the fusing roller 11 within a given range. When the temperature of the fusing roller 11 exceeds the predetermined set value because the controller fails in controlling the temperature of the fusing roller 11, a contact (not shown) of the thermostat 16 becomes open to cut off the supply of power to the halogen lamp 12.

Power consumption of a conventional fusing device using the halogen lamp 12 as a heat source is large. In particular, the conventional fusing device requires a fairly long warming-up time when power is supplied to the fusing device. Thus, a new fusing device having a short warming-up time is required.

SUMMARY OF THE INVENTION

The present invention provides a fusing device for an electrophotographic image forming apparatus that reduces a warming-up time by using melting heat of a supercooled working fluid during cold-start of the fusing device.

According to one aspect of the present invention, there is provided a fusing device for an electrophotographic image forming apparatus. The device includes a heat pipe, both ends of which are sealed and in which a predetermined amount of a supercooled working fluid capable of crystallizing and producing heat when acted on by a mechanical force is contained, a cylindrical roller which surrounds the heat pipe, and a heating element which is installed between the cylindrical roller and the heat pipe. At least one mechanical unit, which applies a mechanical force to the heat pipe and crystallizes the supercooled working fluid, is provided.

Also, the device may further include a cooling fan which supercools the working fluid.

Also, the mechanical unit may be a vibrator attached to one end side of the heat pipe.

Also, the vibrator may include a timer which operates the vibrator for several seconds only during cold-start.

Also, the vibrator may further include a motor, and the motor and the heating element may be connected in parallel to an external power supply.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other aspects and advantages of the present invention will become more apparent by describing in detail preferred embodiments thereof with reference to the attached drawings in which.

DETAILED DESCRIPTION OF THE PREFERRED EMBODIMENTS

Figure 1:
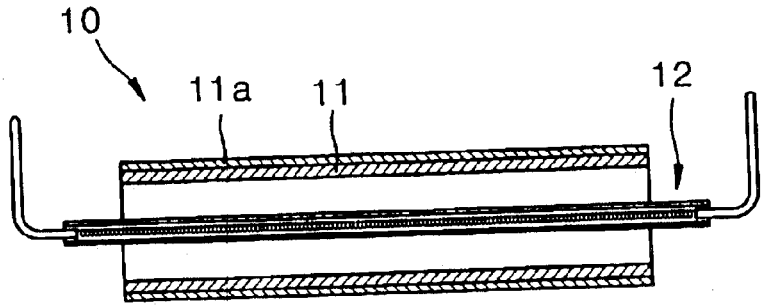
FIG. 1 (PRIOR ART)
FIG. 1 is a schematic profile cross-sectional view of a conventional fusing roller using a halogen lamp as a heat source.
Figure 2:
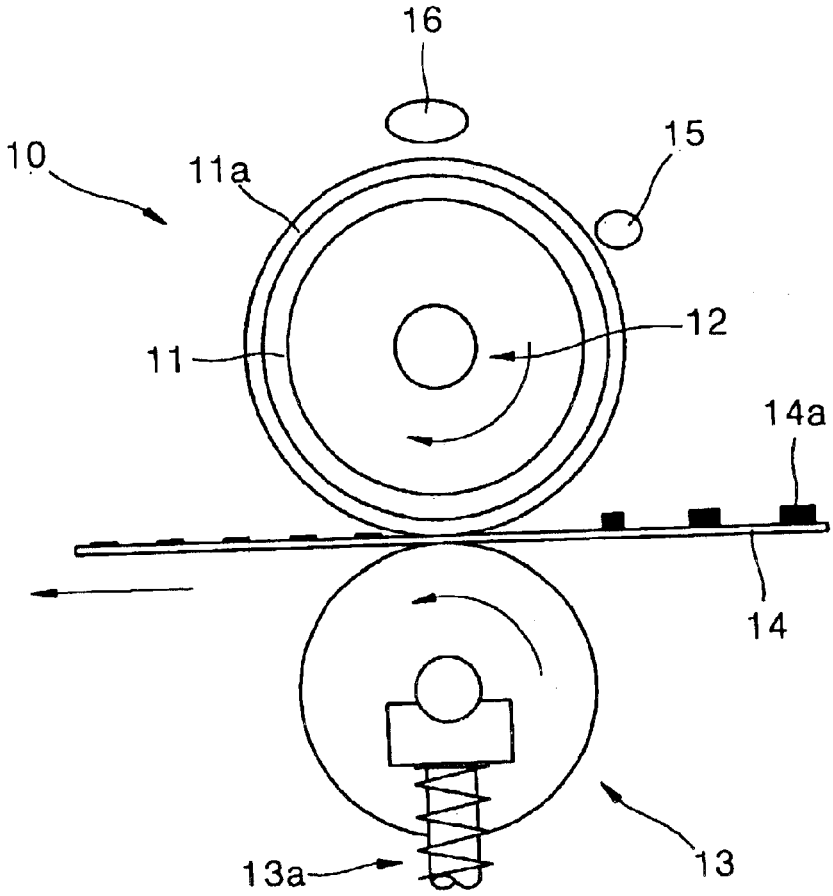
FIG. 2 (PRIOR ART)
FIG. 2 is a schematic frontal cross-sectional view of a conventional fusing device using the fusing roller of FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures. Thicknesses of layers or regions shown in drawings are exaggerated for clarity of the specification.

Figure 3:
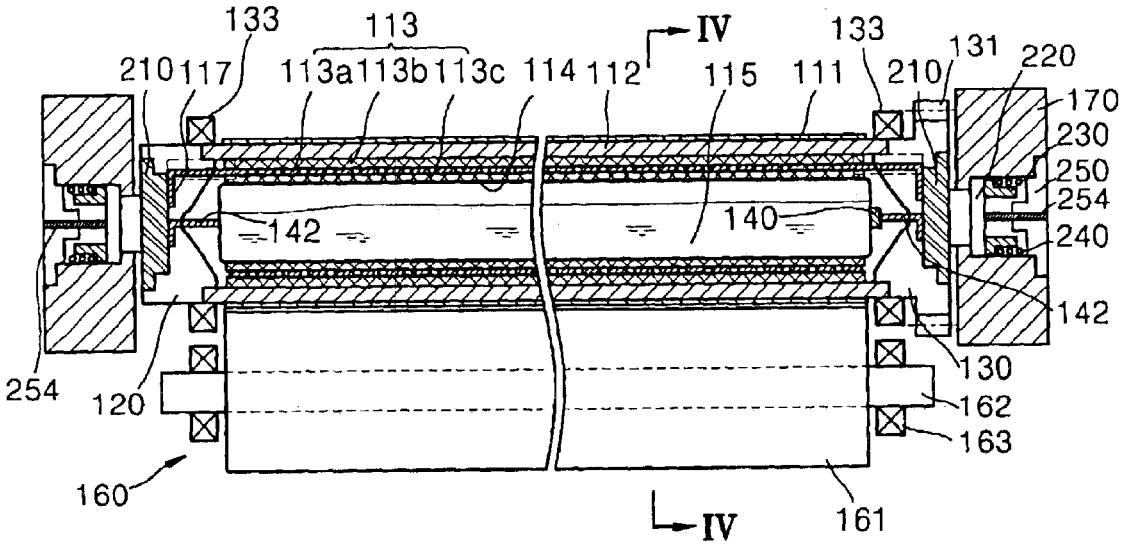
FIG. 3 is a schematic frontal cross-sectional view of a fusing device for an electrophotographic image forming apparatus according to an embodiment of the present invention.
Figure 4:
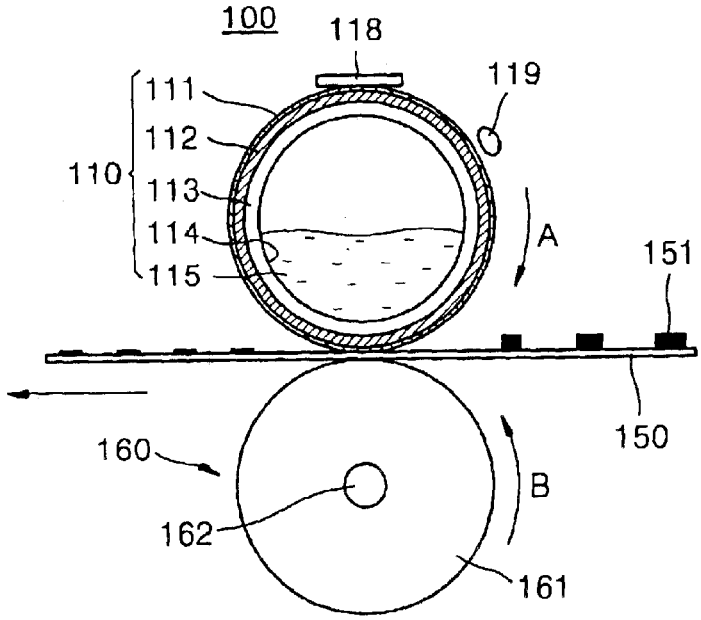
FIG. 4 is a cross-sectional view taken along line IV—IV of FIG. 3.

FIG. 3 is a schematic frontal cross-sectional view of a fusing device for an electrophotographic image forming apparatus according to a first embodiment of the present invention, and FIG. 4 is a cross-sectional view taken along line IV—IV of FIG. 3. Referring to FIGS. 3 and 4, a fusing device 100 includes a fusing roller 110 having a cylindrical roller 112 which rotates in a direction in which a sheet of printer paper 150 having a toner image 151 thereon is ejected, i.e., in a direction indicated by an arrow A, and a pressing roller 160 which is installed to face the fusing roller 110 through the paper 150 therebetween and rotates in a direction indicated by an arrow B to be in a contact with the fusing roller 110.

A toner protective layer 111 is formed of TEFLON® to a predetermined thickness, i.e., at a thickness of 20–30 $\mu$m, on the cylindrical roller 112. A heater 113 is disposed on an inner surface of the cylindrical roller 112, and a heat pipe 114, both ends of which are sealed, is disposed on an inner surface of the heater 113.

Meanwhile, a thermistor 118, which measures a surface temperature of the fusing roller 110, is installed on the toner protective layer 111. Also, a thermostat 119 is installed at one side of the toner protective layer 111 and cuts off power supplied to the heater 113 and prevents overheating when the surface temperature of the fusing roller 110 is rapidly increased.

The heater 113 includes an Ni—Cr resistive coil 113*a* which generates heat by electricity supplied from an external power supply. Mica sheets 113*b* and 113*c*, which are insulating layers, are placed on and under the resistive coil 113*a*. The heater 113 includes a lead 117 which connects electricity to the resistive coil 113*a* formed on both ends of the heater 113. A Cr—Fe coil may be used as the resistive coil 113*a* in one embodiment of the present invention.

The heat pipe 114 is formed in a tube shape, and both ends of the pipe are sealed. A predetermined amount of a working fluid 115 is contained in the heat pipe 114. The working fluid 115 is a sodium acetate solvent and exists in a supercooled liquid state at a room temperature. In general, the sodium acetate solvent is used as a heat pack. The sodium acetate solvent is increased to a predetermined temperature, i.e., 54 C, when the sodium acetate is crystallized by an external shock. Also, if the temperature of the sodium acetate solvent exceeds 120 C due to heat generated in the heater 113, water, which is mixed with the sodium acetate to form the sodium acetate solvent, is separated from the sodium acetate. The separated water, as well as water remaining in the sodium acetate solvent, is vaporized, and thus, the working fluid 115 serves as a thermal medium which transfers the heat to the cylindrical roller 112, prevents a temperature deviation on the surface of the cylindrical roller 112, and heats the overall cylindrical roller 112 within a short time.

If a sodium acetate solvent in which 10 g of sodium acetate mixed with 75 g of water is used as the working fluid 115, and the sodium acetate solvent supercooled at a room temperature is stimulated, sodium acetate is crystallized, and the temperature of the sodium acetate solvent is increased to about 54 C. Here, if the percentage of sodium acetate in a sodium acetate solvent is increased, the temperature due to crystallization is increased, but the increase is very slight. Thus, preferably, the ratio of sodium acetate to water in the sodium acetate solvent is 100–150% by weight. The working fluid 115 takes a volume ratio of 5–70% with respect to the volume of the heat pipe 114, preferably, 50–65%. A volume ratio of the working fluid 115 less than 5% is not preferable because a dry out is highly likely to occur.

Meanwhile, preferably, a cooling device, for example, a cooling fan (not shown), is provided at one side of the fusing roller 110. When the image forming apparatus is off, the cooling fan may be used to supercool the sodium acetate solvent in the heat pipe 114.

The heat pipe 114 is formed of copper (Cu), aluminum (Al), or aluminum alloy. The cylindrical roller 112 is heated by the heater 113 and by the vaporized heat generated from the working fluid 115 in the heat pipe 114. The heat transferred to the cylindrical roller 12 then fuses the toner 151, which is in a powder state formed on the paper 150. The cylindrical roller 112 is formed of stainless steel, aluminum (Al), or copper (Cu)

A vibrator 140, which is electrically driven, is attached to one end side of the heat pipe 114. During a cold-start, an externally-controlled power is supplied to the vibrator 140, and the vibrator 140 is driven by a timer for a predetermined amount of time. The vibrator 140 vibrates one end side of the heat pipe 114 to vibrate the sodium acetate solvent 115, thereby solidifying the sodium acetate solvent 115. Due to a heat generated in the solidifying process, the working fluid 115 is instantaneously increased to a predetermined temperature, for example, 54 C. Power connection to a motor of the vibrator 140 will be described later.

First and second end caps 120 and 130 are inserted in both ends of the cylindrical roller 112. The structure of the second end cap 130 is substantially similar to the first end cap 120, the significant difference being that a gear 131 is formed along an outer surface of the second end cap 130. The gear on the outer surface of the second end cap 130 is engaged with a gear (not shown) of a motor (not shown), and is rotated by that motor's gear. Also, bearings 133 are installed at both ends of the fusing roller 110 to support the rotating fusing roller 110.

Figure 5A:
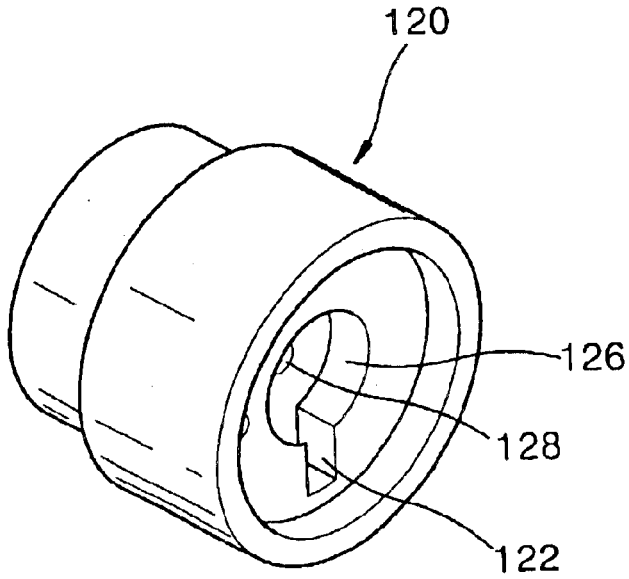
FIGS. 5A and 5B are perspective views of a first end cap of FIG. 3.
Figure 5B:
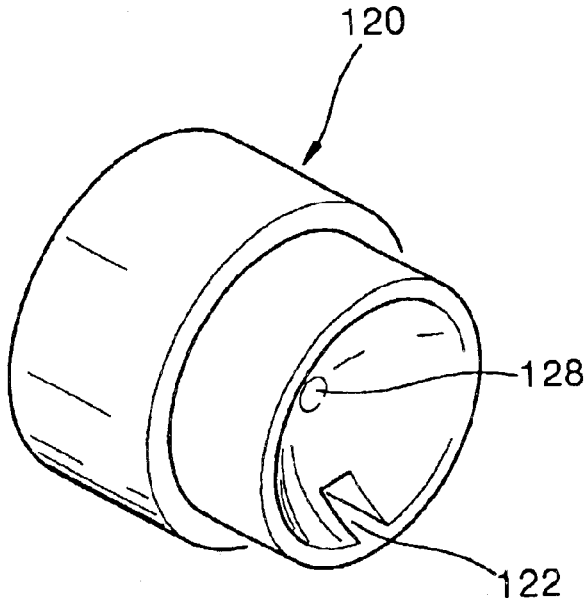
Figure 6A:
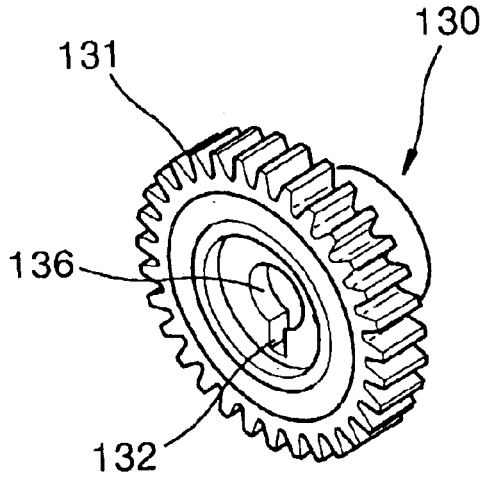
FIGS. 6A and 6B are perspective views of a second end cap of FIG. 3.
Figure 6B:
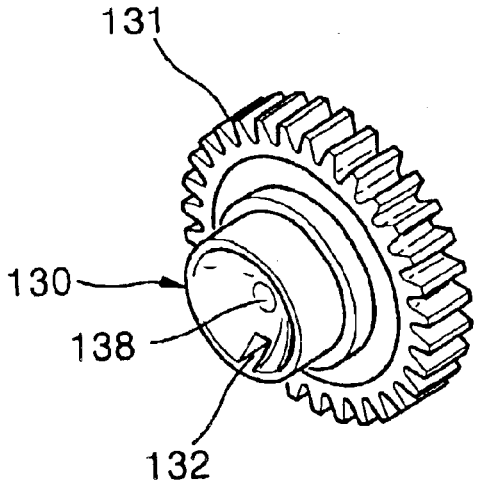

FIGS. 5A and 5B are perspective views of a first end cap 120 of FIG. 3, and FIGS. 6A and 6B are perspective views of a second end cap 130 of FIG. 3. Referring to FIGS. 5A through 6B, lead holes 122 and 132, through which a lead (142 of FIG. 3) is connected to both ends of the resistive coil 113*a*, and lead holes 128 and 138, through which a lead (142 of FIG. 3) is connected to a motor (not shown) of the vibrator 140, are formed in the first and second end caps 120 and 130, respectively. One terminal of the motor of the vibrator 140 is connected to one end side of the heat pipe 114, and is connected to external power through the lead 142 provided at the other end side of the heat pipe 114. The other terminal of the motor of the vibrator 140 is connected to the external power through the lead 142. Thus, the heater 113 and the motor of the vibrator 140 are connected in parallel to the external power, and a controlled power is supplied to the heater 113 and the motor of the vibrator 140. Electrode grooves 126 and 136, in which an electrode 210 is inserted, are formed at the center of the first and second end caps 120 and 130 opposite to the end of the heat pipe 114. The electrode 210 supplies electricity to the leads 117 and 142 which pass through the lead holes 122, 132, 128, and 138, respectively.

Figure 7:
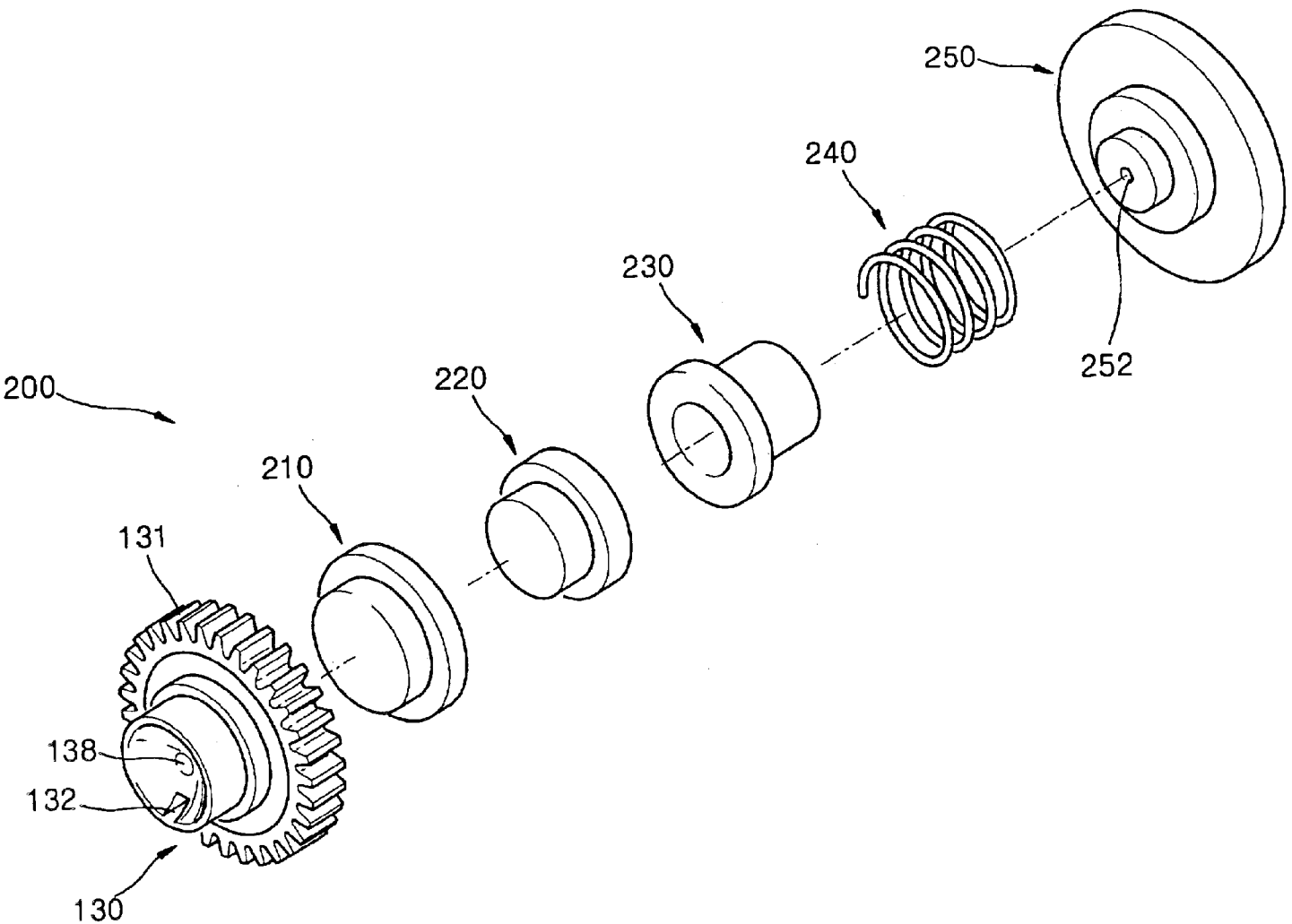
FIG. 7 is an exploded perspective view of a power connection unit of FIG. 3.

FIG. 7 is an exploded perspective view of a power connection unit 200 connected to the second end cap 130. Referring to FIG. 7, the power connection unit 200 is installed in a frame (170 of FIG. 3) and transfers external power to the heater 113. The power connection unit 200 includes an electrode 210 inserted in the electrode grooves 126 and 136, a brush 220 which contacts the electrode 210, and an elastic element 240 which closely adheres the brush 220 to the electrode 210 for an electrical contact. The brush 220 is connected to a lead (254 of FIG. 3) supplied from an external power supply and transfers electricity to the electrode 210.

The elastic element 240 provides an elastic force to a spacer 230 so that the brush 220 is closely adhered to the electrode 210. Even though thermal expansion or thermal contraction repeatedly occurs while the fusing roller 110 is operated, the elastic element 240 absorbs the resulting deformation to prevent the brush 220 from being isolated from the electrode 210. Preferably, a compression spring is used as the elastic element 240. In this embodiment, a lead (254 of FIG. 3) from the external power supply is connected to the brush 220 through a lead hole 252. In this embodiment, the lead 254 and the elastic element 240 could make incidental contact, and sparks could occur. Thus, the spacer 230 is installed between the brush 220 and the elastic element 240, in order to prevent a spark and also to prevent the end cap 130 from contacting the frame 170 due to the drawn-back brush 220.

An end of the elastic element 240 is confined in the frame 170 by an insulating plate 250. The insulating plate 250 supports the elastic element 240. Thus, the brush 220 is first installed in a through hole formed in the frame 170. Then the spacer 230 and the elastic element 240 are installed in the through hole. Next, the insulating plate 250 is installed so that the elastic element 240 is not drawn back.

The first and second end caps 120 and 130 may be made of a resin, such as polyphenylene sulfide (PPS), in which a filler material such as glass fiber, having small thermal deformation even at a high temperature, is inserted. Poly butylene terephthalate (PBT) and nylon are other possible preferred materials for the first and second end caps 120 and 130.

The pressing roller 160 includes an elastic roller 161, which contacts the fusing roller 110 and forms a fusing nip therebetween, and a shaft 162 which supports the elastic roller 161. Bearings 163, disposed at the circumference of the end of the shaft 162, support the pressing roller 160.

A process of manufacturing the fusing device 110 of an electrophotographic image forming apparatus having the above structure according to the present invention will be described below.

One end of a nearly cylindrical tube, which will be used as the heat pipe 114, is sealed. An injection hole is formed at the other end of the cylindrical tube, through which a compression medium supplied from outside, i.e., a compressed liquid, is injected. In this case, it is preferable that deformation is reduced during the enlarging process at both ends of the cylindrical tube by forging both the ends in advance to remove a ductility and to planarize. Next, a circumference of the cylindrical tube 114 is wound by a mica sheet 113*c*. Then the resistive coil 113*a* is wound around the mica sheet 113*c*. Subsequently, the circumference of the cylindrical tub 114 wound by the resistive coil 113*a* is again wound by a mica sheet 113*b*. Next, the cylindrical tube 114 is inserted inside the cylindrical roller 112, an outer surface of which is coated with TEFLON®. Subsequently, the compression medium is injected into the cylindrical tube 114 through the injection hole at the end of the cylindrical tube 114 under a predetermined pressure, i.e., 150 bars, and thereby the cylindrical tube 114 is enlarged. As a result, the cylindrical tube 114 and the heater 113 are closely adhered to the inside of the cylindrical roller 112. Therefore, the cylindrical tube 114 is enlarged, and an air gap is not formed between the heater 113 and the cylindrical roller 112, thus improving heat transfer efficiency.

The operation of the fusing device for an electrophotographic image forming apparatus having the above structure according to the present invention will be described in detail with reference to the accompanying drawings.

First, a cold start of the fusing device, in which the heat pipe filled with a predetermined volume of a sodium acetate solvent in a supercooled state at a room temperature is installed, will be described. If a controlled power is supplied from the external lead 254, this power is connected to the lead 117 of the heater 113 and the lead 142 of the motor of the vibrator 140 through the brush 220 and the electrode 210. Then, the vibrator 140 is driven by the timer for a predetermined amount of time and vibrates part of the sodium acetate solvent 115 in the heat pipe 114. Due to this vibration, part of the sodium acetate starts to be crystallized and heated such that the temperature of the working fluid 115 is increased to 54 C. As a result, the heat pipe 114 is increased to a predetermined temperature. Heat is also generated at the resistive coil 113*a*. Most of the heat generated at the heater 113 is transferred to the cylindrical roller 112. As such, the fusing roller 110 is rapidly increased to a target temperature, i.e., 180 C.

Subsequently, heat generated at the heater 113 is transferred to the heat pipe 114. Due to this heat, the temperature of the heat pipe 114 is increased. If the temperature of the heat pipe 114 is increased over 120 C, the water which was mixed with the sodium acetate in the heat pipe 114 is heated and vaporized, and the heat formed by producing this steam is transferred to the cylindrical roller 112 through the heater 113 installed on the circumference of the heat pipe 114. Heat generated at the heater 113 and heat generated at the working fluid 115 is transferred to the cylindrical roller 112 such that the fusing roller 110 is maintained at a predetermined temperature. In particular, a heat transfer rate of the steam in the heat pipe 114 is high. Thus, a temperature deviation on the surface of the fusing roller 110 can be greatly decreased, and printing quality of the fusing device 100 is improved.

Subsequently, in a printing mode, the toner 151 is transferred in a powder state onto the paper 150, and the paper 150 passes between the fusing roller 110 and the pressing roller 160, and the toner 151 is fused onto the paper 150 by the fusing roller 110 maintained at a predetermined temperature.

Meanwhile, as the fusing roller 110 fuses the paper 150, the heat of the fusing roller 110 is taken to the paper 150, and the steam inside the heat pipe 114 loses heat and is liquefied. Then, the working fluid 115, to which heat is transferred by the heater 114, is vaporized such that the surface temperature of the fusing roller 110 is maintained at a target temperature suitable for fusing the toner 151 onto the paper 150. As such, the working fluid 115 in the heat pipe 114 serves as a thermal medium which repeatedly performs vaporization and liquefaction and maintains the fusing roller 110 at a predetermined temperature.

In general, a fusing temperature of a toner image is about 160–190 C. The fusing device 100 according to the present invention reaches the target temperature within about 12 seconds. The thermistor 118 measures the surface temperature of the fusing roller 110 and a controller (not shown) maintains the surface temperature of the fusing roller 110 within a predetermined range suitable for fusing the toner 151 onto the paper 150. If adjustment of the surface temperature fails and the surface temperature of the fusing roller 110 rapidly increases, the thermostat 119 cuts off the power connection unit 200 connected to the thermostat 119 through a mechanical operation and prevents a rapid increase in the surface temperature of the fusing roller 110. This power supply operation may be varied according to a set temperature, and may be performed using various controlling methods such as periodic on/off, pulse width modulation (PWM), or proportional and integral (PI).

Meanwhile, if an electrophotographic image forming apparatus having a fusing device according to the present invention is entered into a long-term standstill state, and the fusing device 100 stops, the cooling fan at one side of the image forming apparatus is operated such that the working fluid, including sodium acetate, is supercooled, and the supercooled sodium acetate solvent is again formed in the heat pipe 114.

As described above, in the fusing device for an electrophotographic image forming apparatus according to the present invention, during a cold-start, a warming-up time can be reduced using a melting heat of a supercooled sodium acetate solvent, and in a printing mode, the surface temperature of a fusing roller can be uniformly maintained using a thermal medium in the heat pipe.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fusing device for an electrophotographic image forming apparatus, the device comprising:

a heating pipe, both ends of which are sealed and in which a predetermined amount of a working fluid is contained, wherein the working fluid is supercooled at room temperature, and crystallizing and producing heat when acted on by a mechanical force;

a cylindrical roller which surrounds the heat pipe;

a heating element which is installed between the cylindrical roller and the heating pipe;

at least one mechanical unit which applies the mechanical force to the heating pipe and crystallizes the supercooled working fluid; and a pressing roller which closely adheres to the fusing roller.

2. The device of claim 1, wherein the working fluid is a sodium acetate solvent.

3. The device of claim 2, wherein the sodium acetate solvent has a volume ratio of 50–65% with respect to the volume of the heating pipe.

4. The device of claim 2, wherein the ratio of sodium acetate to water in the sodium acetate solvent is 100–150% by weight.

5. The device of claim 1, further comprising a cooling fan which supercools the working fluid.

6. The device of claim 1, wherein the mechanical unit is attached to one end side of the heating pipe.

7. The device of claim 6, wherein the mechanical unit is a vibrator.

8. The device of claim 7, wherein the vibrator includes a timer which operates the vibrator for several seconds only during cold-start.

9. The device of claim 7, wherein the vibrator includes a motor, and the motor and the heating element are connected in parallel to an external power supply.

10. The device of claim 9, wherein one terminal of the motor is connected to one end side of the heat pipe, and the remaining side of the heat pipe and the remaining terminal of the motor are each connected to the external power supply.

* * * * *